United States Patent [19]

James

[11] 4,053,810

[45] Oct. 11, 1977

[54] LOSSLESS TRAVELING WAVE BOOSTER TUBE

[75] Inventor: Bertram G. James, Redwood City, Calif.

[73] Assignee: Varian Associates, Inc., Palo Alto, Calif.

[21] Appl. No.: 699,763

[22] Filed: June 25, 1976

[51] Int. Cl.[2] ..... H01J 25/34

[52] U.S. Cl. ..... 315/3.6; 315/3.5; 315/39.3

[58] Field of Search ..... 315/3.5, 3.6, 39.3

[56] References Cited

U.S. PATENT DOCUMENTS

| | | | |
|---|---|---|---|
| 2,922,920 | 1/1960 | Convert | 315/3.6 |
| 3,274,428 | 9/1966 | Harris | 315/3.6 |
| 3,397,339 | 8/1968 | Beaver et al. | 315/3.5 |
| 3,414,756 | 12/1968 | Farney | 315/3.5 |
| 3,576,460 | 4/1971 | Harman | 315/3.6 |
| 3,846,664 | 11/1974 | King et al. | 315/3.6 |

*Primary Examiner*—Saxfield Chatmon, Jr.
*Attorney, Agent, or Firm*—Stanley Z. Cole; Richard B. Nelson; Robert K. Stoddard

[57] ABSTRACT

A traveling-wave amplifier tube adapted for use as a booster of transmitted signals has very small internal circuit attenuation so that it may be used without an electron beam as a transparent, passive path for low transmitter power. When the booster tube's beam is excited, the signal is amplified about 10dB. Upper bandedge instabilities in the lossless tube are inhibited by a lower cutoff frequency of the circuit near the output end than near the input end, so that bandedge power can flow both ways out of the large-signal output end.

6 Claims, 3 Drawing Figures

LOSSLESS TRAVELING WAVE BOOSTER TUBE

FIELD OF THE INVENTION

The invention pertains to traveling-wave amplifier tubes, particularly tubes generating high microwave powers in which instabilities arise at frequencies near the band edge of a bandpass slow wave circuit. Circuits commonly used consist of a series of mutually coupled cavities.

DESCRIPTION OF THE PRIOR ART

Linear-beam traveling-wave tubes (TWT's) for generating large amounts of microwave power over extensive frequency ranges have typically used slow-wave interaction circuits consisting of a series of self-resonant elements coupled together to form a band-pass filter circuit. The most successful circuit elements have been hollow cavities having apertures in their walls through which the electron beam passes and is coupled to the rf electric fields of the cavities.

U.S. Pat. No. 3,233,139 issued Feb. 1, 1966 to Marvin Chodorow and assigned to the assignee of the present invention describes circuits in which the coupling between adjacent cavities is a negative mutual inductance. In this case the fundamental space harmonic is a forward wave. Another widely used circuit is the "folded waveguide" in which adjacent cavities are coupled by inductive irises, giving a backward-wave fundamental space harmonic. To interact with the electron beam, these circuits are used in a higher order space harmonic which is a forward wave. Such circuits are described by J. F. Gittins "Power Travelling-Wave Tubes", American Elsevier, 1965, particularly pages 67-80.

When these band-pass circuits are coupled to a high-voltage, high-current electron beam having a velocity near the phase velocity of the selected space-harmonic wave of the circuit, interaction occurs with amplification of the wave. A most common trouble is that instabilities and oscillations occur at frequencies near the edges of the passband of the periodic filter, circuit, mos t prevalent at the high-frequency cutoff band-edge frequency, where the group velocity of the circuit wave goes to zero. That is, no energy is propagated down the circuit, and the resulting standing-wave resonant impedance becomes very large, approaching infinity if the loss in the circuit approaches zero. Even though the beam velocity may be not quite synchronous with the phase velocity of the circuit at this frequency, the interaction can cause oscillations. Two types of oscillations are recognized: dc oscillations and drive-induced oscillations. The dc oscillations occur with no rf signal introduced and occur as mentioned above due to the high circuit impedance and non-synchronous beam interaction. Drive-induced oscillations occur when the tube is driven to saturate its rf output. Under this condition, many electrons are slowed down by delivering kinetic energy to the circuit. Slowed electrons going at a velocity synchronous with the circuit wave at cutoff frequency interact strongly with it, producing instablity. Several schemes have been derived to eliminate band-edge oscillations. Simply introducing radio-frequency loss in the circuit is widely used to control all forms of instability in TWT's. By reducing the resonant impedance at cutoff it reduces band-edge oscillations. Unfortunately, it also reduces the gain and efficiency of the tube in the operating band.

A more sophisticated scheme for bandpass TWT circuits is illustrated by U.S. Pat. No. 3,365,607 issued Jan. 23, 1968 to J. A. Ruetz et al and assigned to the assignee of the present invention. A frequency-sensitive loss is coupled to the circuit to provide high attenuation at frequencies near the upper cutoff but rapidly decreasing at lower frequencies where the tube is operated. In the aforementioned patent, the frequency selectivity is provided by the low-frequency cutoff properties of a waveguide containing the lossy material. Other frequency-selective schemes have been used, such as lossy elements resonant at the band edge. All of these schemes have the problem that their frequency selectivity is not completely sharp. Some loss occurs at frequencies in the useful band, reducing gain and efficiency.

The problem of the high impedance at cutoff is aggravated by the inherent impedance mismatch to the transmission lines coupling the slow-wave circuits to input and output signal means and to dissipative loads. The transmission lines must generally have passbands bracketing that of the slow-wave circuit, and therefore reasonably small characteristic impedance at the cut-off frequencies of the circuit where the circuit impedance becomes very large. The resulting impedance mismatch generates wave reflections which contribute greatly to the bandedge instabilities. Methods to more nearly match the unequal impedances as well as to cut down the length of circuit having an exactly constant cutoff frequency are described in U.S. Pat. No. 3,576,460 issued Apr. 27, 1971 to W. A. Harman and assigned to the assignee of the present invention. Sections of the slow-wave circuit near its ends have cutoff frequencies higher than the central section, acting at the cutoff frequency of the central section as quarterwave transformers between the high circuit impedance and the lower transmission line impedance.

SUMMARY OF THE INVENTION

An object of the invention is to provide a traveling-wave amplifier tube having improved stability at its upper band-edge frequency.

A further object is to provide a tube having negligible loss for signals transmitted through it.

A further object is to provide a tube having high efficiency and short length.

These objects are attained by providing a coupled-cavity slow-wave circuit in which a final portion near the useful output power transmission line has a lower value of its high frequency cutoff than that of the adjacent, preceding portion.

The circuit may also contain more than two portions, each with decreasing upper cutoff frequency progressing in the direction of the electron beam.

DESCRIPTION OF THE PREFFERED EMBODIMENTS

The operation of the invention will be described as used in a so-called "transparent" or "booster" TWT because it provides particular advantages for this kind of an amplifier. It will be readily apparent, however, that the invention can be of great value in more conventional TWT's.

The "booster" tube has a fairly low gain, such as 10dB. It may be used to increase the output power of existing transmitters by simply adding it as an output amplifying stage. Another important use is for dual-mode transmitters. In applications such as electronic countermeasures it is often desired to switch rapidly from a mode of operation transmitting a relatively low peak power such as a cw signal, to an alternate mode with high peak power, such as a pulsed signal. With an output booster stage having a traveling-wave circuit with negligible attentuation, the low power mode can be directed through the booster tube to the antenna with no beam being drawn through the booster. When the high-power mode is desired, voltage is applied to the booster which then amplifies the low-power output.

Prior-art schemes of suppressing band-edge instabilities by putting lossy elements in the slow-wave circuit are not suitable for a dual-mode booster tube because the inevitable in-band attenuation decreases the low-mode power output. Even in the high-mode, the booster tube is so short that in-band attentuation reduces its efficiency.

Figure 1:
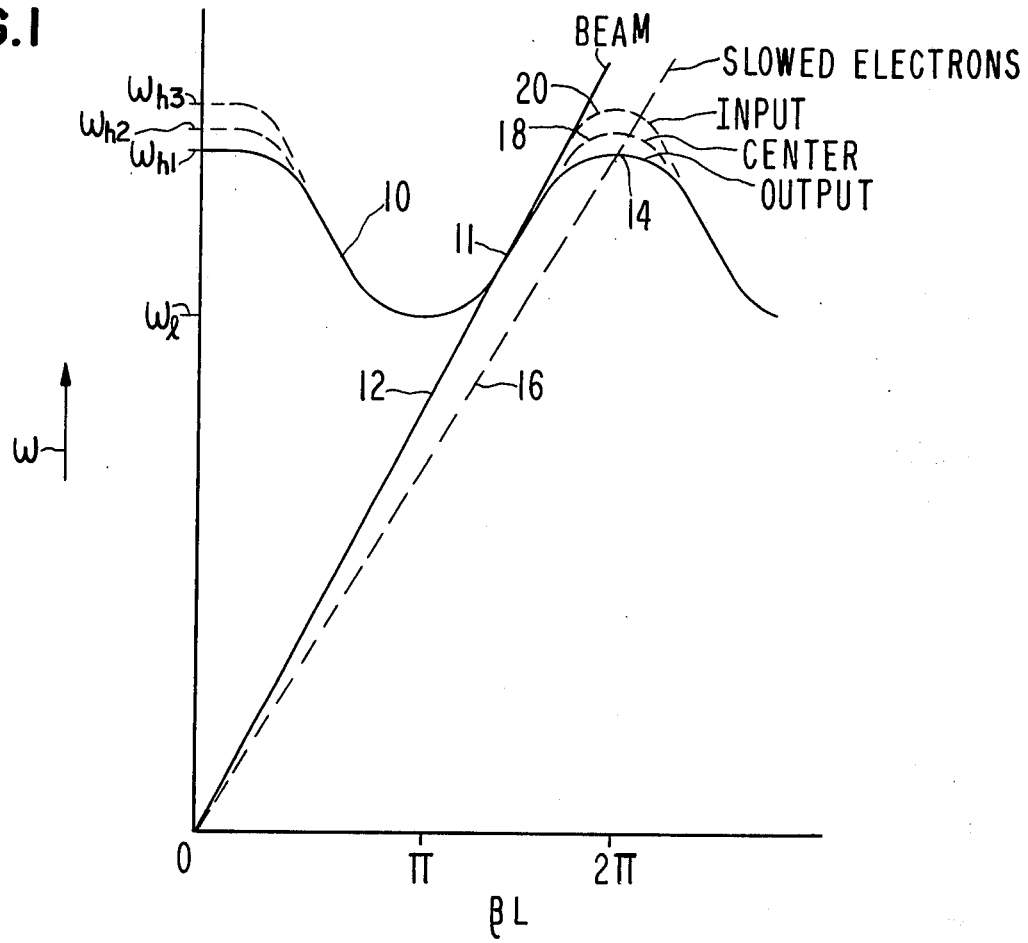
FIG. 1 is a schematic dispersion diagram of a bandpass circuit as used in the invention.
Figure 2:
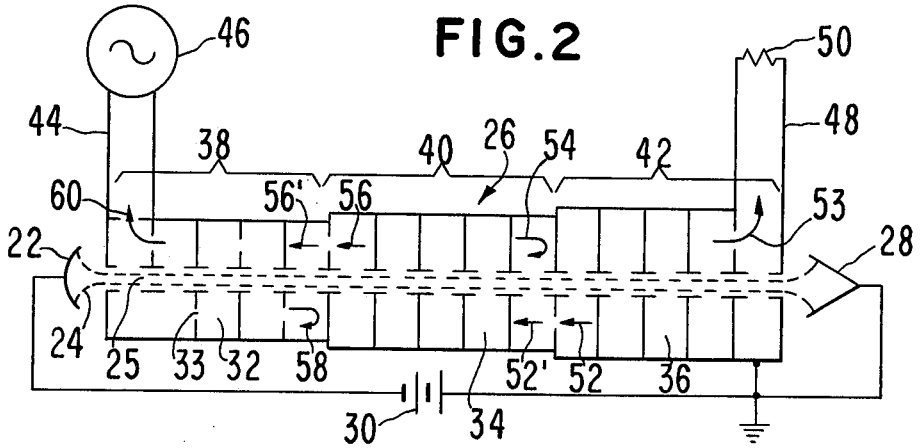
FIG. 2 is a schematic diagram of a traveling wave tube incorporating the invention.

FIG. 1 illustrates the dispersion characteristics of a coupled-cavity, bandpass slow-wave circuit such as shown in FIG. 2. In FIG. 1 the ordinate is radian frequency $\omega$ and the abscissa is phase shift per circuit period $\beta$ L, where $\beta$ is the phase shift per unit length and L is the period length of the circuit. The propagating band of frequencies extends between the high-frequency cutoff $\omega_{h1}$ and the low-frequency cutoff $\omega_l$. The dispersion characteristic 10 is a roughly sinusoidal curve between these limits. It of course repeats at multiples of $2\pi$ phase shift. This particular circuit has a backward-wave fundamental space harmonic, i.e. the slope of $\omega$ vs $\beta$L is negative for $\beta L < \pi$. Traveling-wave interaction over a wide frequency band is accomplished by using the space-harmonic wave represented by the positively sloped portion 11 of characteristic 10. The velocity of a synchronous electron beam is represented by diagonal line 12. At $\beta L = 2\pi$, point 14 corresponds to the high-frequency cutoff $\omega_{h1}$. Here the group velocity (slope of the dispersion curve) goes to zero, energy is not propagated, and the resonant impedance of the line as seen by the electron beam is very high. Even though the beam is not quite synchronous with the wave, instabilities and even oscillations can occur due to the high impedance.

Also, when the tube is driven to saturation, in the large signal region electrons are slowed down by transferring their kinetic energy to the circuit wave. A stream of slowed electrons represented by the velocity-line 16 can be in exact synchronism at cutoff point 14, producing drive-induced oscillations (DIO).

The TWT is illustrated schematically if FIG. 2. Conventional details of the vacuum envelope, beam-focusing magnets and cathode heater are omitted for clarity.

Cathode 22 emits a beam of electrons 24 which is focused through apertures 25 in an extended slow-wave circuit 26. After exiting circuit 26 the beam is collected in a collector 28. A beam voltage supply 30 maintains cathode 22 negative to grounded circuit 26 and collector 28 to accelerate beam 24.

Circuit 26 is formed of a series of cavities 32, 34, 36 coupled in series by inductive irises 33. A first portion 38 of circuit 26 is matched at its input end to an input transmission line 44, adapted to receive signals from a signal source 46 such as a low-power driver TWT. Following portion 38 in the direction of beam travel is an intermediate circuit portion 40. Further downstream is an output circuit portion 42 whose output end is matched to an output transmission line 48, adapted to transmit signals to a useful load 50 such as an antenna.

Dispersion curve 10 in FIG. 1 is taken to represent the properties of output portion 42 (FIG. 2).

Intermediate portion 40 is designed to have a dispersion characteristic 18 (FIG. 1) with an upper cutoff frequency $\omega_{h2}$ higher than the $\omega_{h1}$ cutoff of output portion 42. Similarly, input portion 38 has a characteristic 20 with cutoff $\omega_{h3}$ higher than intermediate portion $\omega_2$. Raising the upper cutoff frequency can be effected by a slight decrease in the diameter of the cavities, which are typically cylindrical.

The effect of these novel bandpass characteristics is illustrated in FIG. 2 by the arrows in the circuit portions. In each portion, the arrows indicate the power flow of waves having very nearly the cutoff frequency of that particular section. It should be noted that for a bandpass circuit of finite length, there can be some power flow even at or above the theoretical cutoff frequency, due to evanescent waves associated with the circuit ends.

Looking now at output circuit portion 42, power at band-edge frequency $\omega_{h1}$ produced by dc beam interaction or by drive-induced interaction can flow out of portion 42 either as a forward wave 53 into output transmission line 48 or as a backward wave 52 into intermediate portion 40 where it continues as a backward wave 52'. Most of the drive-induced power is generated in output portion 42 where the rf signal is large.

In intermediate portion 40, forward wave energy 54 generated at its cutoff frequency $\omega_{h2}$ cannot enter output portion 42 because 42 is well cut off at $\omega_{h2}$. Wave 54 is thus reflected to join any backward-wave energy 56 generated in portion 40.

The conditions at the junction between intermediate portion 40 and imput portion 38 are the same as above. Forward wave energy 58 is reflected and backward wave energy 56 is transmitted as 56'. At the input end of the circuit all backward-wave energy is coupled out into the input transmission line 44.

One of the benefits of the inventive circuit 26 is the bandedge energy generated in the upstream portions 38, 40 cannot enter output portion 42 to add to drive-induced energy generated therein and multiply the instability. Another advantage is that the length of circuit having any single, precise cutoff frequency is reduced, so the gain at such single frequency is limited and the tendency to oscillate is inhibited.

The invention does not require that all portions of the circuit have cutoff frequencies progressively lower in the direction of beam flow. In fact, the invention can be used in TWT's incorporating either the aforecited U.S. Pat. No. 3,576,460 or U.S. Pat. No. 3,414,756 issued Dec. 3, 1968 to G. K. Farney and assigned to the assignee of the present application. The latter patent teaches an upward tapering of the upper cutoff frequency of a bandpass circuit adjacent its terminated ends. It thus improves the bandedge match in much the same manner as the U.S. Pat. No. 3,576,460 patent. In either case, the improved match for bandedge frequencies further enhances the benefits of the present invention.

Figure 3:
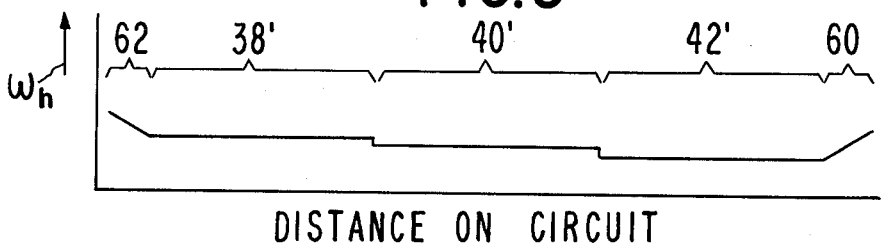
FIG. 3 is a graph of cutoff frequencies of a TWT incorporating another embodiment.

FIG. 3 illustrates the variation in upper cutoff frequency through the length of a booster TWT combining the present invention and the U.S. Pat. No. 3,414,756 patented invention. In an input matching portion 62 coupled to an input transmission line as in FIG. 2 the cutoff frequency tapers downward as taught in U.S. Pat. No. 3,414,756. In the next, extended input circuit portion 38' corresponding to portion 38 of FIG. 2 the cutoff is constant. In the central portion 40' corresponding to portion 40 of FIG. 2 the cutoff is slightly lower than in portion 38' and in the output portion 42' corresponding to portion 42 of FIG. 2 it is still lower. Past the uniform output portion 42' is an output matching portion 60 in which the cutoff frequency tapers up as taught in U.S. Pat. No. 3,414,756.

It will be obvious to those skilled in the art that the cutoff frequencies need not change by abrupt jumps between circuit portions, but may be gradually tapered, even over the entire circuit length, to achieve the same result.

In a transparent booster tube the invention provides stability without deliberately introducing any harmful attenuation. The invention can be profitably applied in other TWT's, such as high gain tubes with severed circuits. The invention provides a simpler and cheaper circuit by eliminating complicated lossy elements. It can also be used in conjunction with lossy elements where stability problems are particularly severe. The described embodiments are intended to be only illustrative. The invention is intended to be limited only by the following claims and their legal equivalents.

I claim:

1. In a traveling-wave amplifier tube, a coupled-cavity slow-wave circuit adapted to interact with a stream of electrons over an extended path, output transmission line means coupled to an output end of said circuit at the downstream end of said path, means for coupling electromagnetic energy to an input end of said circuit at the upstream end of said path, the improvement wherein: a plurality of cavities forming a first portion of said circuit nearer said output end have outer walls with larger dimensions transverse to said beam path than those of a plurality of cavities forming a second, adjacent portion nearer said input end, whereby the upper cutoff frequency of said first portion is lower than that of said second portion.

2. The apparatus of claim 1 wherein said means for coupling electromagnetic energy to said input end comprises transmission line means coupled to said input end and adapted to receive electromagnetic energy from an external source.

3. The apparatus of claim 1 including a plurality of sequential portions of said circuit upstream of said first portion, the upper cutoff frequencies of said portions being sequentially lower in the downstream direction.

4. The apparatus of claim 2 wherein the electromagnetic transmission of said circuit is attentuated only by losses in the circuit structural material.

5. The apparatus of claim 1 wherein the upper cutoff frequency of a third portion of said circuit adjacent said output end is higher than said cutoff frequency of said first portion.

6. The apparatus of claim 1 wherein said outer walls of said cavities are generally right circulat cylinders coaxial with said beam and said transverse dimensions are the radii of said cylinders.

* * * * *

UNITED STATES PATENT AND TRADEMARK OFFICE

CERTIFICATE OF CORRECTION

PATENT NO. : 4,053,810

DATED : October 11,1977

INVENTOR(S) : Bertram G. James, Redwood City, Calif.

It is certified that error appears in the above-identified patent and that said Letters Patent are hereby corrected as shown below:

Column 1, line 42, "periodic filter, circuit," should read -- periodic filter circuit --;
Column 3, line 23, "attentuation" should read -- attenuation --;
Column 4, line 13, "$W_2$" should read -- $W_{h2}$ --;
Column 4, line 47, "the" (3d occurrence) should read -- that --;
Column 6, line 24, "attentuated" should read -- attenuated --;
Column 6, line 31, "circulat" should read -- circular --.

Signed and Sealed this

*Thirtieth* Day of *September 1980*

[SEAL]

*Attest:*

SIDNEY A. DIAMOND

*Attesting Officer*

*Commissioner of Patents and Trademarks*